US007070390B2

(12) United States Patent
Powell

(10) Patent No.: US 7,070,390 B2
(45) Date of Patent: Jul. 4, 2006

(54) COMPONENT WITH INTERNAL DAMPING

(75) Inventor: Christopher A. Powell, Cardiff (GB)

(73) Assignee: Rolls-Royce plc, London (GB)

( * ) Notice: Subject to any disclaimer, the term of this patent is extended or adjusted under 35 U.S.C. 154(b) by 109 days.

(21) Appl. No.: 10/878,533

(22) Filed: Jun. 29, 2004

(65) Prior Publication Data

US 2005/0047918 A1 Mar. 3, 2005

(30) Foreign Application Priority Data

Aug. 20, 2003 (GB) ..... 0319554.2

(51) Int. Cl.
*F01D 5/26* (2006.01)

(52) U.S. Cl. ..... 416/224; 416/232; 416/229 R; 416/500

(58) Field of Classification Search ..... 416/224, 416/232, 233, 238, 229 R, 500
See application file for complete search history.

(56) References Cited

U.S. PATENT DOCUMENTS 2,828,941 A * 4/1958 Foley ..... 416/231 R
3,758,233 A 9/1973 Crosse et al.
3,867,068 A 2/1975 Corsmeier et al.
4,441,859 A 4/1984 Sadler
6,669,447 B1 * 12/2003 Norris et al. ..... 416/224

FOREIGN PATENT DOCUMENTS

| | | |
|---|---|---|
| EP | 0 568 201 B1 | 7/1996 |
| EP | 0 926 312 A2 | 6/1999 |
| GB | 2 078 310 A | 1/1982 |
| GB | 2371 095 A | 7/2002 |

* cited by examiner

*Primary Examiner*—Edward K. Look
*Assistant Examiner*—Dwayne J White
(74) *Attorney, Agent, or Firm*—Oliff & Berridge, PLC

(57) ABSTRACT

A component such as a blade for use in a gas turbine engine comprises a body 2 formed from outer panels 8, 10 defining an internal cavity 12. A damping element 14 is provided in the cavity 12 and is secured at one end between the panels 8, 10 at one end of the body 2, for example adjacent the root of the blade. Damping material fills the cavity 12 and so extends between the damping element 14 and the panels 8, 10. Vibration induced in the blade causes relative movement between the body 2 of the blade and the damping element 14, causing energy loss in the damping material which damps the vibration.

The components 8, 10, 14 may be secured by a diffusion bonding process.

22 Claims, 2 Drawing Sheets

COMPONENT WITH INTERNAL DAMPING

This invention relates to a component provided internally with a damping element, and to a method of manufacturing such a component. The invention is particularly, although not exclusively, concerned with components for use in gas turbine engines, for example fan blades.

Blades of gas turbine engines are subject to vibration induced by flutter and distortions in the gas flow over the blades. Vibration can cause the blade to resonate, and this can cause a reduction in aerodynamic efficiency of a compressor in which the blade is installed. This necessitates a larger safety margin between the maximum capacity of the compressor and the operational capacity. In extreme circumstances resonance can cause direct damage to the blade.

It is known to damp such vibrations by coating the outer surface of the blade with a suitable damping material, for example as disclosed in U.S. Pat. No. 3,758,233. That document discloses a fan blade coated with a ceramic material, such as magnesium aluminate ($MgO.Al_2O_3$). A problem with such coatings is that they impose constraints on the surface finish obtainable on the aerodynamic surfaces of the blade. Furthermore, such coatings tend to be vulnerable both to erosion and foreign object damage (FOD) with the result that the aerodynamic performance of the blades, and their response to vibration, can be degraded.

Conventionally, rotors of gas turbine engines are assembled from a rotor disc and a plurality of blades which are secured to the periphery of the disc. The means of attachment between the blades and the disc, for example a fir-tree root arrangement, frequently provides some frictional damping which reduces the amplitude of any vibrations and so increases the resistance of the components to high cycle fatigue failure. It is becoming more common for blades and discs to be welded together to form unitary bladed discs, or blisks. Blisks have no mechanical joint at the roots of the blades, and so the damping effect achieved at such joints is absent. There is consequently an increased need for alternative damping means to be provided in blisks.

A further development in blade manufacture is disclosed in EP 0568201, and comprises the manufacture of blades, such as fan blades, by a superplastic forming and diffusion bonding technique which results in a hollow blade, ie a blade having at least one internal cavity. In the technique disclosed in EP 0568201, at least two sheets are laid in face-to-face contact with a predetermined pattern of stop-off material applied to one of the sheets. The sheets are diffusion bonded together, except where this is prevented by the stop-off material. Subsequently, internal pressure is created between the sheets, causing them to deform superplastically to form cavities in the regions where diffusion bonding was prevented by the stop-off material. This technique can be used to manufacture hollow fan blades which can be welded to a disc to form a blisk.

GB 2078310 discloses a damping system for a gas turbine rotor blade. The damping system comprises a pin which lies within a passage which extends longitudinally of the blade. Frictional contact between the pin and the passage absorbs energy to damp vibrations of the blade.

EP 0926312 discloses another form of damping system for a gas turbine rotor blade. The blade has cavities which are filled with a visco elastic damping material. The cavities are closed by a panel which provides an outer surface of the blade. An internal panel may be embedded in the damping material.

According to one aspect of the present invention, there is provided a component comprising a body having an internal cavity defined by an internal surface of the body, a damping element being secured to the body and cantilevered therefrom into the internal cavity, damping material being disposed within the cavity between the damping element and the internal surface.

The damping element may be in the form of a panel, ie it may have a thickness which is substantially less than its width. For example the ratio of the thickness to the width may be less than 0.1 and more preferably less than 0.05.

The body may comprise an outer peripheral wall which defines the external surface of the component. The outer wall may comprise two panels which are bonded together at overlying edge regions.

In a preferred embodiment, the damping element extends through the cavity substantially equally spaced from the panels, with the damping material provided in the gap between the damping element and each panel. The damping material preferably fills the entire cavity, and may be bonded to the damping element and/or the panels. The damping material is preferably a visco-elastic material, such as a natural or synthetic rubber such as a fluorosilicone rubber.

The damping element may be secured to the body by bonding it between the panels. The bonds between the panels themselves, and between the panels and the damping element, may be diffusion bonds. The bond may extend substantially entirely around the periphery of the component.

In a preferred embodiment, the component may be a component of a turbine engine, and more specifically a gas turbine engine. The component may be a rotor blade, such as a compressor blade, so that the damping element will serve to damp vibration of the blade in operation of the engine in which the blade is fitted. The present invention may be applied to a series of blades permanently secured, for example by welding, to a rotor disc to form a blisk. It will be appreciated, however, that the present invention may also be applied to other components, whether or not of gas turbine engines, for which additional damping is required to minimise vibration.

Where the component is a rotor blade, the damping element is preferably secured to a region of the body at or near the blade root, the damping element then extending from the region of securement towards the tip of the blade. The damping element preferably extends across a substantial proportion, for example, more than 50%, of the chord of the blade.

The component, especially if it is in the form of a rotor blade, may be made by a diffusion bonding process as disclosed in EP 0568201.

According to another aspect of the present invention, there is provided a method of manufacturing a component, in which method:

(a) a plurality of panels are joined together in a diffusion bonding process to form a body of the component, a damping element being disposed between the panels during the diffusion bonding process whereby a diffusion bond is formed at an attachment region of the damping element between the damping element and at least one of the panels;

(b) the panels are deformed by applying internal pressure between the panels, thereby to create an internal cavity in which the damping element extends; and (c) a damping material is introduced into the cavity to extend between the damping element and at least one of the panels.

During deformation of the panels, the panels, the panels may be heated to a temperature at which the internal pressure causes the panels to deform superplastically.

In order to avoid the formation of a diffusion bond being created between the damping element and the body except at the one end region, a stop-off material may be applied to the damping element and/or to the panels in regions where no diffusion bonding is required.

For a better understanding of the present invention, and to show more clearly how it may be carried into effect, reference will now be made, by way of example, to the accompanying drawings, in which.

Figure 1:
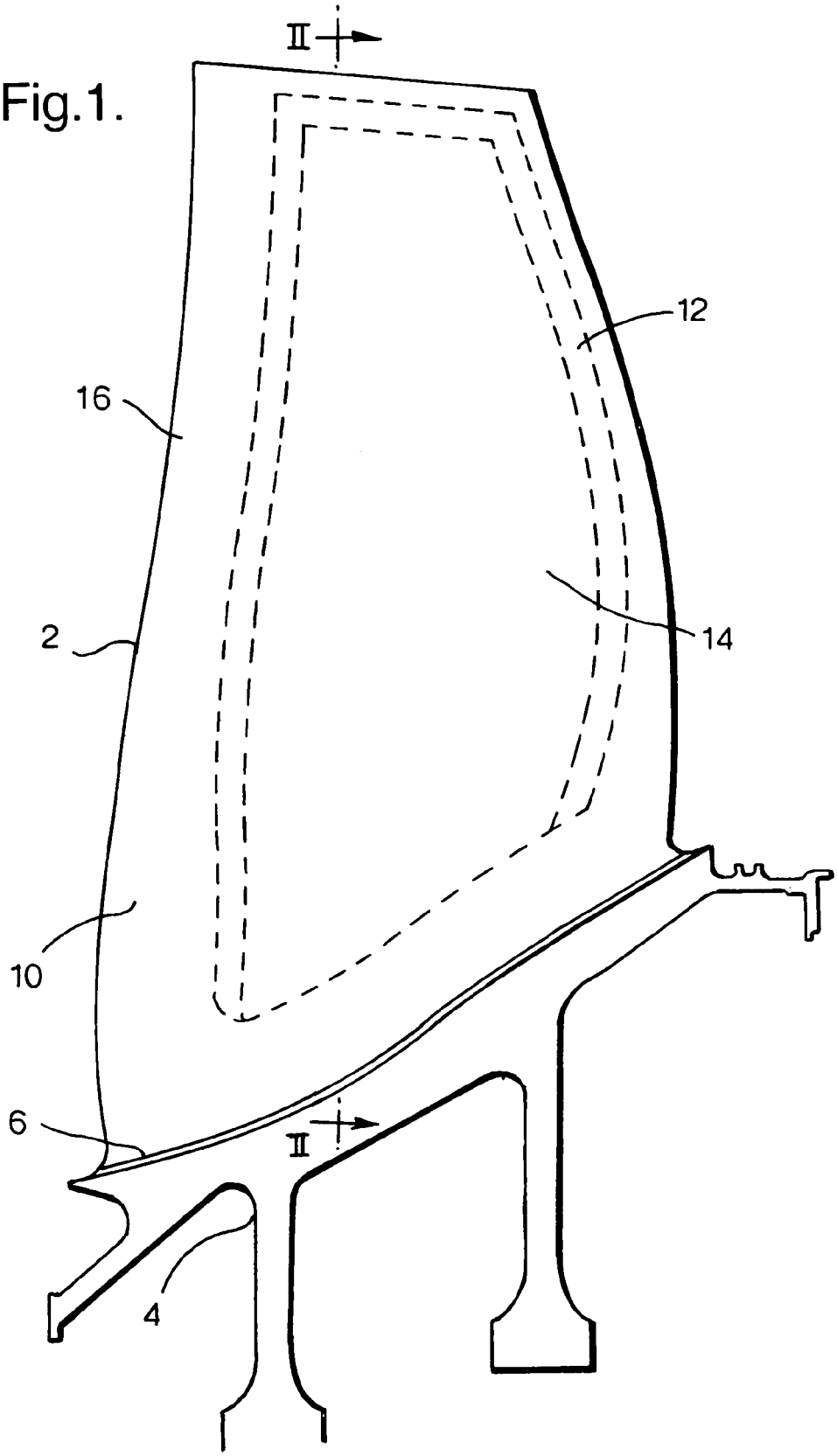
FIG. 1 shows a compressor blade of a gas turbine engine.
Figure 2:
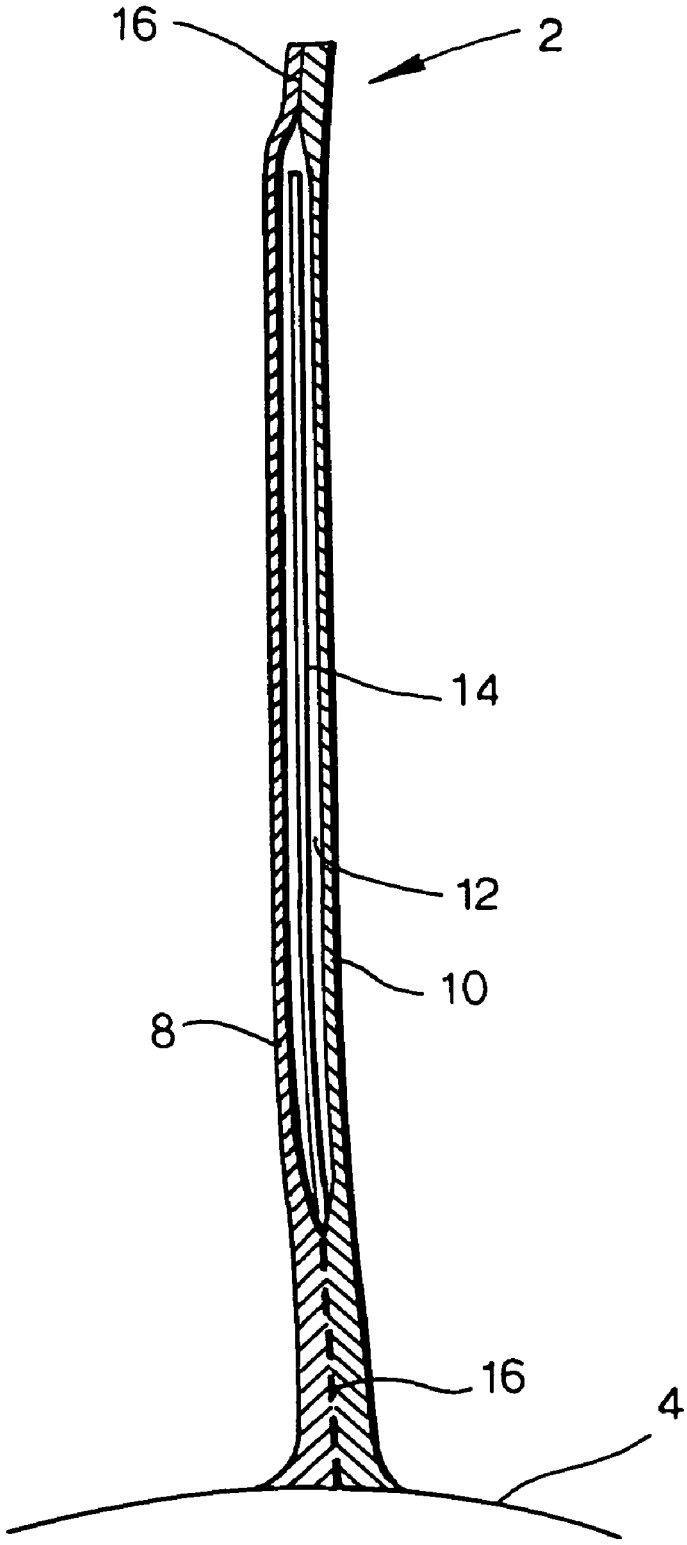
FIG. 2 is a cross-section on the line ll—ll in FIG. 1.

The compressor blade shown in FIGS. 1 and 2 comprises a body 2 welded to a disc 4 at a weld line 6. As shown in FIG. 2, the body 2 is formed from a pair of panels 8, 10 which are bonded together around their periphery at a bond 16 to define between them a cavity 12.

A damping element 14, in the form of a thin internal panel, is disposed within the cavity 12. The damping element 14 is attached to the body 2 at its radially inner end, with respect to the axis of the disc 4, by bonding between the panels 8 and 10. It is cantilevered from this inner end such that the major portion of the damping element 14 extends freely into the cavity 12, and its periphery lies inwards of the bond 16 between the panels 8 and 10. The majority of the damping element 14 therefore, is free to float within the cavity 12.

The cavity 12 is filled with a visco-elastic damping material. Many suitable materials are available, for example natural or synthetic rubber such as fluorosilicone rubber. Preferably, the damping material has a relatively low density, for example lower than the density of the material of the panels 8, 10 and the damping element 14, which may be a titanium alloy. The damping material preferably fills the cavity 12 so that it wholly surrounds the damping element 14. The damping material is preferably bonded to the inner surfaces of the panels 8, 10 and the surfaces of the damping element 14.

In operation, vibration of the blade is transmitted through the damping material in the cavity 12 to the damping element 14. Losses in the damping material in the cavity 12 dissipate the energy of the vibrating body 2, so attenuating the amplitude of vibration.

Also, the vibration characteristics of the damping element 14 may serve to damp the vibrations of the body 2.

Because the damping element 14 is cantilevered from the body 2 only at the root of the blade, but otherwise extends into the cavity 12 unattached to the panels 8 and 10, the body 2 does not need to support the centrifugal force exerted on the damping element 14 as the disc 4 rotates. Consequently, the panels 8 and 10 can be made relatively thin, so avoiding any significant increase in the weight of the blade.

The blade may be made in a diffusion bonding and superplastic deforming process as disclosed in EP 0568201. In such a process, the precursors of the panels 8 and 10 and a precursor of the damping element 14 are stacked in face-to-face engagement. A coating of stop-off material is applied to the internal faces of the panels 8 and 10 and/or the surfaces of the damping element 14, with the periphery of the panels 8 and 10 and the root end of the damping element 14 left uncoated. The resulting stack is then heated and subjected to high pressure so that diffusion bonds 16 are created between those contacting metal-to-metal regions which are not coated with the stop-off material. Thus, the outer periphery of the panels 8 and 10 are bonded together, with the root end of the damping element 14 being bonded between the root end regions of the panels 8 and 10.

When bonding has been achieved, the assembly is heated to a temperature at which it can be hot formed into a desired configuration in which, for example, the assembly has an arcuate cross-section with a twist between the ends of the assembly, approximating to a desired blade profile. Subsequently, the assembly is heated to a temperature at which superplastic deformation of the elements of the assembly can occur, and the assembly is internally pressurised. This forces the unbonded regions of the panels 8 and 10 apart from each other and from the damping element 14. The resulting structure is consequently that of a hollow component, with the damping element 14 extending within the internal cavity 12.

The damping material can then be introduced into the cavity 12, for example by way of the opening through which the assembly is pressurized to cause the superplastic deformation. The damping material may, for example, be introduced in the form of a curable liquid resin which is then cured to form the damping material while in situ in the cavity 12.

The invention claimed is:

1. A component comprising a body having an internal cavity defined by an internal surface of the body, a damping element being secured to the body and cantilevered therefrom into the internal cavity, damping material being disposed within the cavity between the damping element and the internal surface.

2. A component as claimed in claim 1, in which the body comprises an outer wall defining an external surface of the component and the internal surface of the body.

3. A component as claimed in claim 2, in which the outer wall comprises two panels which are bonded together at overlying edge regions.

4. A component as claimed in claim 3, in which the damping element is substantially equally spaced from the panels.

5. A component as claimed in claim 3, in which the damping element is bonded between the panels at a peripheral region of the body, thereby to secure the damping element to the body.

6. A component as claimed in claim 5, in which the bond between the panels, and the bonds between the damping element and the panels, are diffusion bonds.

7. A component as claimed in claim 3, in which the panels are bonded together around substantially the entire periphery of the body.

8. A component as claimed in claim 1, in which the body is formed from titanium alloy.

9. A component as claimed in claim 1, in which the damping element is made from titanium alloy.

10. A component as claimed in claim 1, in which the damping element is in the form of a panel.

11. A component as claimed in claim 1, in which the damping material substantially fills the cavity.

12. A component as claimed in claim 1, in which the damping material is a visco-elastic material.

13. A component as claimed in claim 1, in which the damping material is bonded to the internal surface of the body.

14. A component as claimed in claim 1, in which the damping material is bonded to the damping element.

15. A component as claimed in claim 1, which is the component of a turbine engine.

16. A component as claimed in claim 15, which is a component of a gas turbine engine.

17. A component as claimed in claim 15, which is a rotor blade.

18. A component as claimed in claim 17, in which the damping element is secured to the body of the component at a position adjacent the blade root, and extends in a direction towards the blade tip.

19. A gas turbine engine, including a component in accordance with claim 1.

20. A method of manufacturing a component, in which method:

a plurality of panels are joined together in a diffusion bonding process to form a body of the component, a damping element being disposed between the panels during the diffusion bonding process whereby a diffusion bond is formed at an attachment region of the damping element between the damping element and at least one of the panels;

the panels are deformed by applying internal pressure between the panels, thereby to create an internal cavity in which the damping element extends; and a damping material is introduced into the cavity to extend between the damping element and at least one of the panels.

21. A method as claimed in claim 20, in which, during deformation of the panels, the panels are heated to a temperature at which deformation takes place superplastically.

22. A method as claimed in claim 20, in which a stop-off material is applied to the damping element, and/or to the internal surface of the body, except at the region where the diffusion bond is to be formed, to prevent or minimise diffusion bonding between the damping element and the body over a substantial part of the length of the damping element.

* * * * *